US005181882A

United States Patent [19]

Miyazawa

[11] Patent Number: 5,181,882

[45] Date of Patent: Jan. 26, 1993

[54] COIN RETURN CONTROL SYSTEM FOR VENDING MACHINES

[75] Inventor: Tadashi Miyazawa, Tatebayshi, Japan

[73] Assignee: Sanden Corporation, Gunma, Japan

[21] Appl. No.: 520,825

[22] Filed: May 9, 1990

Related U.S. Application Data

[63] Continuation-in-part of Ser. No. 430,171, Nov. 1, 1989, Pat. No. 5,024,313.

[30] Foreign Application Priority Data

May 9, 1989 [JP] Japan ..... 1-52612[U]

[51] Int. Cl.[5] ..... G07D 1/02

[52] U.S. Cl. ..... 453/63

[58] Field of Search ..... 194/216, 217, 218; 453/16, 17, 61, 62, 63

[56] References Cited

U.S. PATENT DOCUMENTS 3,896,915 7/1975 Hayashi et al. ..... 194/218
4,836,825 6/1989 Smeets et al. ..... 453/49

FOREIGN PATENT DOCUMENTS 2805978 8/1979 Fed. Rep. of Germany ..... 453/17
26093341 1/1987 France .
1566375 2/1978 United Kingdom .
1566202 4/1980 United Kingdom .

*Primary Examiner*—F. J. Bartuska
*Attorney, Agent, or Firm*—Banner, Birch, McKie & Beckett

[57] ABSTRACT

A coin return control system for vending machines is disclosed which includes a predetermined coin denomination detecting portion for detecting the coin denomination predetermined by a coin denomination predetermination switch every time change may have to be paid out by the vending machine. A memory memorizes the coin denomination detected by the coin denomination detecting portion immediately after operating an inventory switch which is a switch other than the coin denomination predetermination switch. A variation detecting portion detects the variation of the coin denomination predetermined by the coin denomination predetermination switch based on the coin denomination detected by the predetermined coin denomination detecting portion and the coin denomination memorized by the memory. An instruction portion instructs the coin paying-out mechanism to return a coin from the auxiliary change retaining tube when the number of coins retained in the change retaining tube corresponding to the coin denomination memorized by the memory is below a predetermined value. A determination portion determines whether or not the instruction portion should instruct the coin paying-out mechanism to return a coin from the auxiliary change retaining tube based on the detected result of the variation detecting portion. Therefore, the coin return control system for vending machines always correctly pays out a necessary coin despite the position of the coin denomination predetermination switch or a faulty read out of the position of the switch.

4 Claims, 4 Drawing Sheets

COIN RETURN CONTROL SYSTEM FOR VENDING MACHINES

This application is a continuation-in-part of U.S. application Ser. No. 07/430,171 filed Nov. 1, 1989 now U.S. Pat. No. 5,024,313.

TECHNICAL FIELD

The present invention relates to a coin return control system for vending machines, and more particularly, to a coin return control system which determines whether a coin should be paid out from a change retaining tube or from an auxiliary change retaining tube.

BACKGROUND OF THE INVENTION

Conventional coin return control systems for automatic vending machines are known which receive coins deposited from outside the machine and pay out coins as change when appropriate. The coin return control system normally pays out a coin from change retaining tubes each corresponding to one of a plurality of coin denominations or types from a coin paying out portion based on an instruction signal from a control portion to operate a coin return chute opening.

As shown in Japanese Patent Laid-open Gazette No. 52-82392, the coin return control system may also be provided with an auxiliary change retaining tube which corresponds to the coin type to be paid out as change. The coin denomination of coins retained in the auxiliary change retaining tube is predetermined by the setting of a coin denomination predetermination switch mechanism which includes small dip switches. A control portion detects the predetermined value of the coin denomination from the dip switches every time the vending machine is used and change is to be delivered and instructs a coin paying-out mechanism to pay out a coin via the auxiliary change retaining tube when the number of the coins which is retained in the change retaining tube of the coin type corresponding to the predetermined denomination is below a predetermined value, for example, when the corresponding change retaining tube has become empty.

That is, as shown in FIG. 1, a coin denomination is first predetermined by a coin denomination predetermination switch at step S1. The output from step S1 is input to step S2. It is determined at step S2 whether or not it is necessary for change to be paid out. If change is to be paid out, the output from step S2 is input to step S3. Otherwise, the output from step S2 returns to the input of step S1. It is determined at step S3 whether or not the coin of the coin denomination predetermined at step S1 is necessary for making change. If it is necessary, the output from step S3 is input to step S5. Otherwise, the output from step S3 is input to step S4. Consequently, a coin is paid out from an appropriate change retaining tube. In step S5, it is determined whether or not the number of the coins in the change retaining tube corresponding to the coin denomination predetermined by the coin denomination predetermining switch in step S1 has fallen to zero. If it is zero, the output from step S5 is input to step S6, and a coin is paid out from the auxiliary change retaining tube. Otherwise, the output from step S5 is input to step S4, and a coin is paid out from the change retaining tube corresponding to the coin denomination predetermined by the coin denomination predetermining switch.

In the above coin return control system, the machine may inadvertently pay out a different denomination of coin than intended since the control portion detects the predetermined value of the coin denomination predetermination switch every time change may be paid out and instructs the coin paying-out mechanism to pay out the coin from the auxiliary change retaining tube. That is, the first predetermined value of the coin type predetermination switch may be different from the predetermined value thereof after passage of a period of time because of external causes, for example, in the event a vending machine operator fails to completely set the dip switches for matching the coin denomination of the coin in the auxiliary change retention tube via the coin denomination predetermination switch mechanism or a liquid such as water invades the interior of the switch causing a faulty reading. If those causes occur, the coin return control system results in the paying out of a different denomination coin from that intended.

SUMMARY OF THE INVENTION

It is a primary object of this invention to provide a coin return control system for vending machines which can always correctly pay out the correct denomination of a coin despite the position of the coin denomination predetermination switch or a faulty read out.

A coin return control system for vending machines according to the present invention comprises a plurality of change retaining tubes each corresponding to a coin type of deposited coins and at least one auxiliary change retaining tube such as is disclosed in copending U.S. application Ser. No. 07/490,544 filed Mar. 5, 1990 of Mr. Nato Satoh, incorporated herein by reference. In accordance with the present invention, a coin denomination predetermination switch predetermines a particular coin denomination for coins retained in the auxiliary change retaining tube. A coin paying-out mechanism returns a coin from one of the plurality of change retaining tubes or the auxiliary change retaining tube when change is required. A predetermined coin denomination detecting portion detects the coin denomination predetermined by the coin denomination predetermination switch every time the machine is used. A memory associated with a control unit memorizes the coin denomination detected by the coin denomination detecting portion immediately after operating a particular inventory switch, which is not the coin denomination predetermination switch. A variation detecting portion detects the variation between the coin denomination predetermined by the coin denomination predetermination switch compared with the coin denomination detected by the predetermined coin denomination detecting portion and the coin denomination memorized in the memory. An instruction portion instructs the coin paying-out mechanism to return a coin from the auxiliary change retaining tube when the number of the coins retained in the change retaining tube corresponding to the coin denomination memorized by the memory is below a predetermined value, for example, when the number of coins has fallen to zero. A determination portion determines whether or not the instruction portion should instruct the coin paying out mechanism to return a coin from the auxiliary change retaining tube based on the detected result of the variation detecting portion.

Further objects, features and other aspects of this invention will be understood from the following detailed description of a preferred embodiment of this invention referring to be annexed drawings.

BRIEF DESCRIPTION OF THE DRAWINGS

FIG. 2(*b*) is a schematic side view including a cut-out portion of a coin return control system as shown in FIG. 2(*a*).

DETAILED DESCRIPTION OF THE PREFERRED EMBODIMENTS

Figure 1:
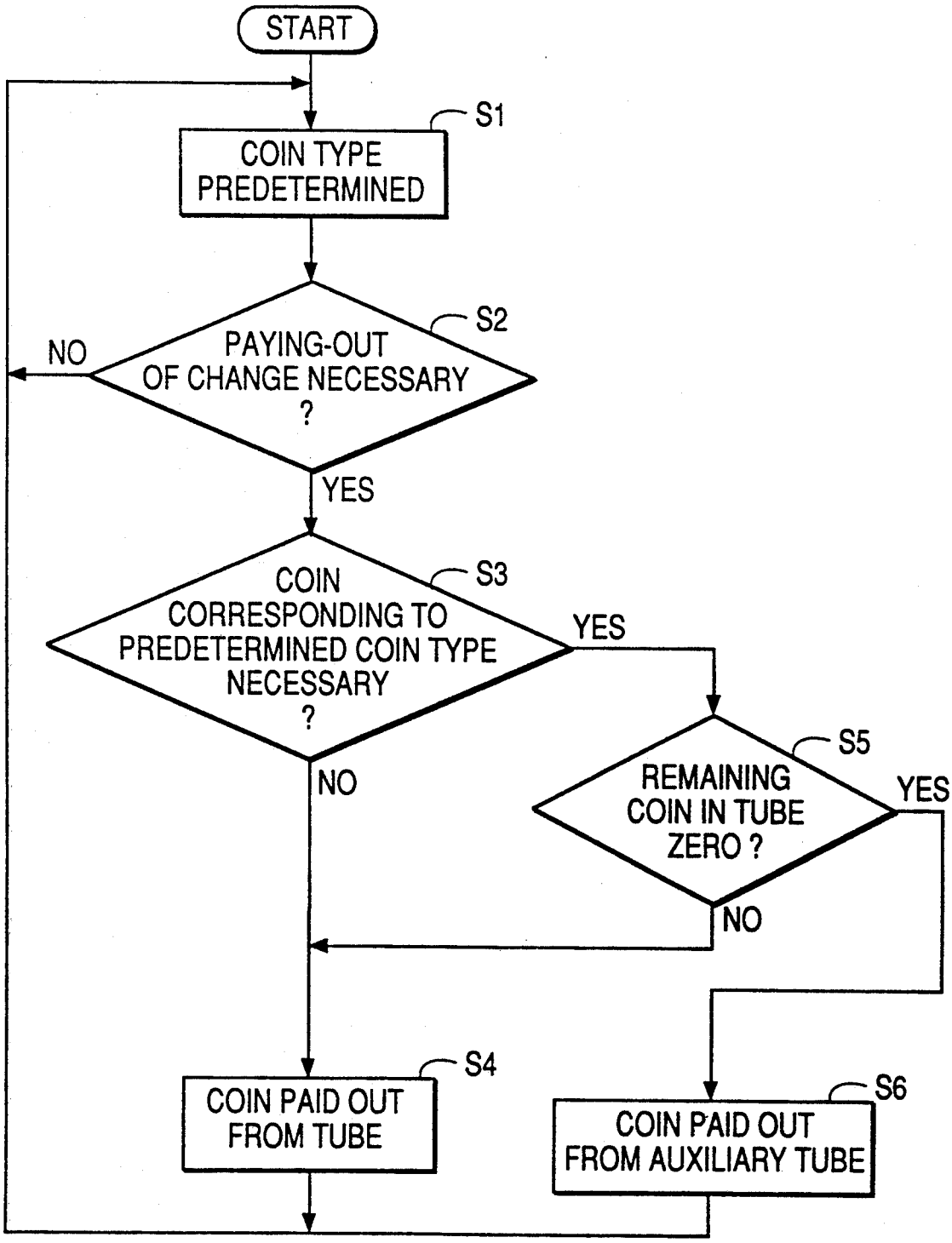
FIG. 1 is a flow chart of a conventional coin return control system.
Figure 2A:
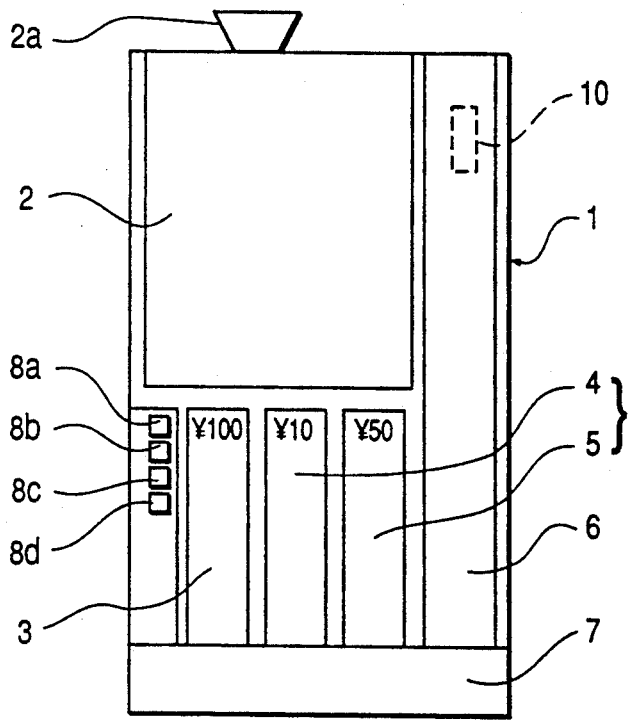
FIG. 2(*a*) is a schematic front view of a coin return control system in accordance with one embodiment of this invention.
Figure 2B:
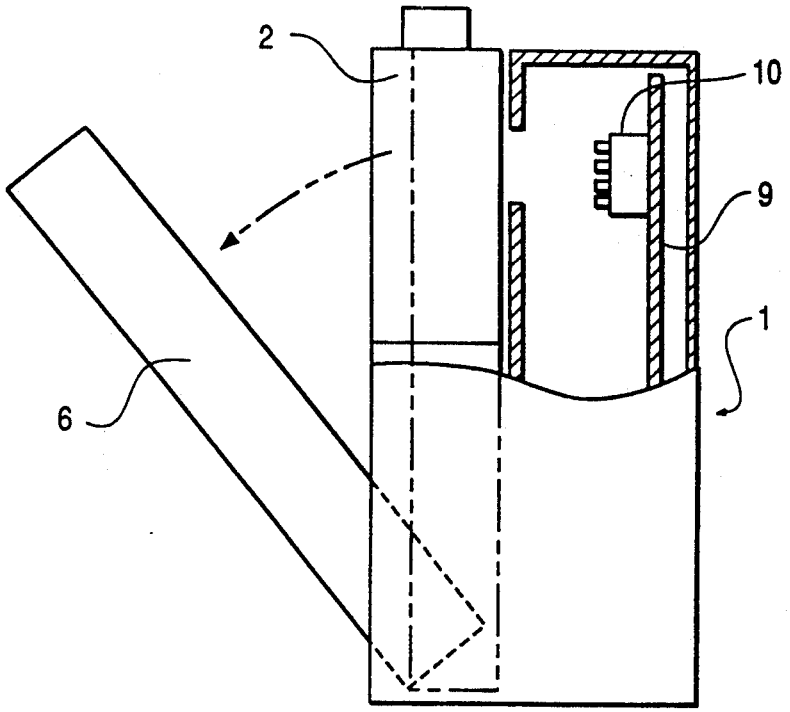

With reference to FIGS. 2(*a*) and (*b*), the construction of a coin return control system for vending machines in accordance with one embodiment of this invention is shown. Coin return control system 1 includes coin distributing mechanism 2 at a front upper position thereof and change retaining tubes 3, 4 and 5 for nickels, dimes and quarter denomination coins, respectively, disposed in series under coin distributing mechanism 2. Auxiliary change retaining tube 6 is most conveniently disposed adjacent to coin distributing mechanism 2 and change retaining tube 5. Coin paying-out mechanism 7 is most conveniently disposed below change retaining tubes 3, 4 and 5, and auxiliary change retaining tube 6. A plurality of switches 8*a*–8*d* corresponding to respective change retaining tubes 3, 4 and 5 and auxiliary tube 6 are disposed adjacent to change retaining tube 3. Referring briefly to FIG. 2(*b*), control unit 9 is most conveniently disposed behind the above-described coin tubes and coin distributing mechanism. Coin denomination predetermination switch mechanism 10 is disposed proximate to control unit 9 at its upper end to enable it to be set by removing auxiliary change retaining tube 6, as shown. Switch mechanism 10 conveniently comprises a set of dip switches which are most conveniently set to the nickel denomination but may be set to another denomination depending on the item to be vended and its sale price.

Referring again to FIG. 2(*a*), a coin deposited into coin inlet 2*a* of coin distributing mechanism 2 is determined as to its authenticity and type during its passage through coin distributing mechanism 2 in a well known manner. Details of construction of coin distributing mechanism 2 are provided in my copending U.S. application Ser. No. 07/430,171 filed Nov. 1, 1989 and incorporated herein as to essential details by reference. The coin determined to be an unacceptable coin (for example, a metal slug or foreign coin) is distributed to a return chute opening (not shown). When a deposited coin is an acceptable coin, and when it is determined to be a quarter denomination coin, it is distributed to change retaining tube 3; when the deposited coin is determined to be a dime, it is distributed to change retaining tube 4; when it is determined to be a nickel, it is distributed to change retaining tube 5. When change retaining tubes 3, 4 and 5 are filled with respective corresponding coins, it is distributed to a secure cash box (not shown). Coin distributing mechanism 2 distributes the deposited coin in accordance with instructions from a control portion 11 (preferably, a micro-computer) comprising a portion of control unit 9.

Figure 3:
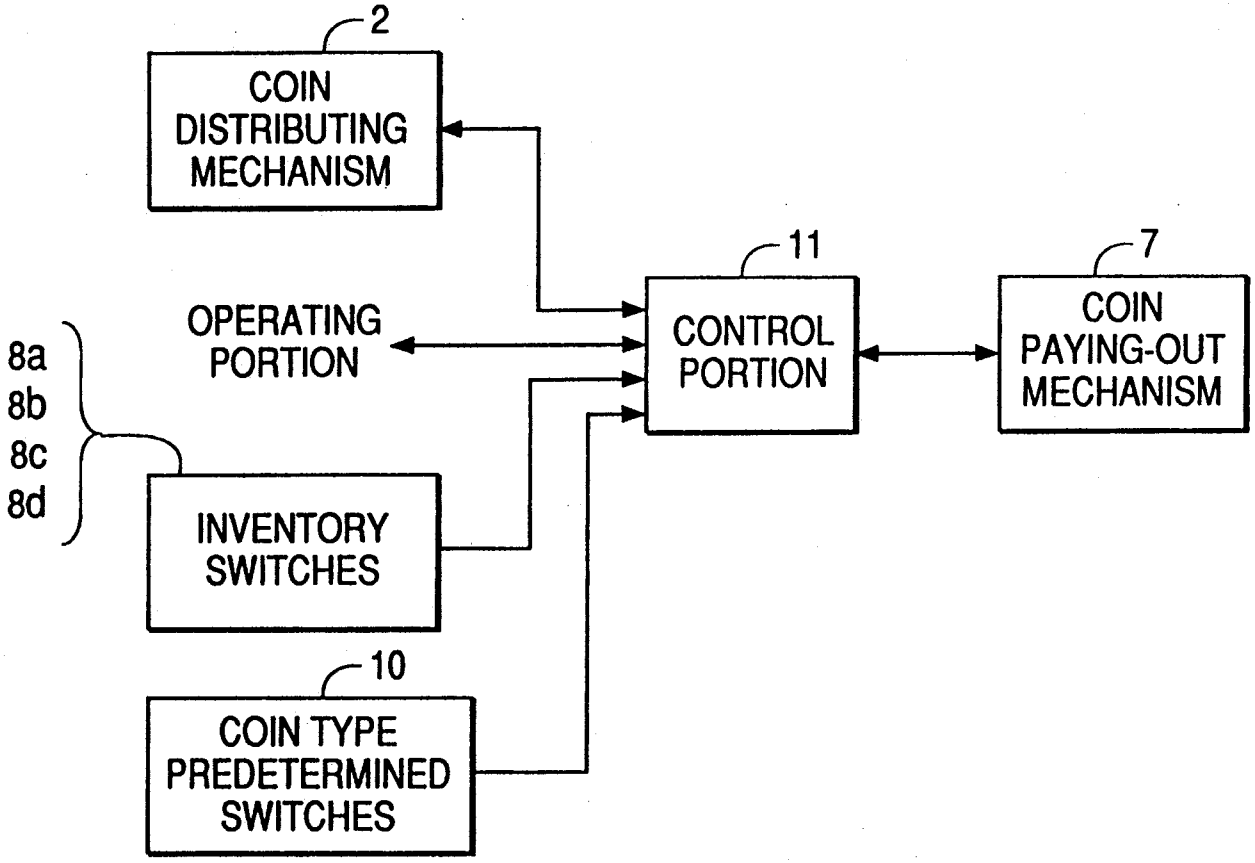
FIG. 3 is a block diagram of an electrical circuit of a coin return control system as shown in FIG. 2(*a*).

Referring now to FIG. 3, control portion 11 is directly connected to several peripheral devices, for example, coin distributing mechanism 2, coin paying-out mechanism 7, inventory switches 8*a*–8*d*, a coin denomination predetermination switch or switches 10 and operating portion 12 of the automatic vending machine in which it is housed, respectively.

Coin distributing mechanism 2 includes a sensor (not shown) to detect the material, form, diameter and the other characteristics of the deposited coin and outputs the detection signal to control portion 11. Coin distributing mechanism 2 operates coin distributing gates (not shown) in accordance with signals output from control portion 11 and so causes the deposited coin to be introduced into the respective corresponding change retaining tubes 3, 4 or 5. Coin paying-out mechanism 7 pays out a coin from change retaining tubes 3, 4 or 5 or auxiliary change retaining tube 6 to a coin return chute opening (not shown) in accordance with the instruction of control portion 11 and also includes a plurality of sensors (not shown) to detect the number of the coins remaining in each of change retaining tubes 3, 4 and 5. When the number of the coins remaining respectively therein is less than a predetermined number for making change, for example, when the number has fallen to zero, coin paying-out mechanism 7 outputs a signal to communicate such a condition to control portion 11 for each retaining tube.

Inventory switches 8*a*–8*d* output a signal to forcedly pay out a coin from change retaining tubes 3, 4 or 5 or auxiliary change retaining tube 6 respectively via control portion 11. For example, before a vending machine is set to sell merchandise, the condition of paying out a coin from change retaining tubes 3, 4 or 5 or auxiliary retaining tube 6 to a coin return chute opening can be tested by operating inventory switches 8*a*–8*d*.

Coin denomination predetermination switch 10 predetermines the coin type of the coin in auxiliary change retaining tube 6, which typically retains the coin most often paid out as change such as nickels. The coin type of the coin paid out as change can be changed by operating coin denomination predetermination switch or switches 10 to different switch positions so that the selected coin type can appropriately correspond to the price of the merchandise. The predetermined value of coin predetermination switch 10 is detected by control portion 11 every time the machine is used or change is to be paid out.

Figure 4:
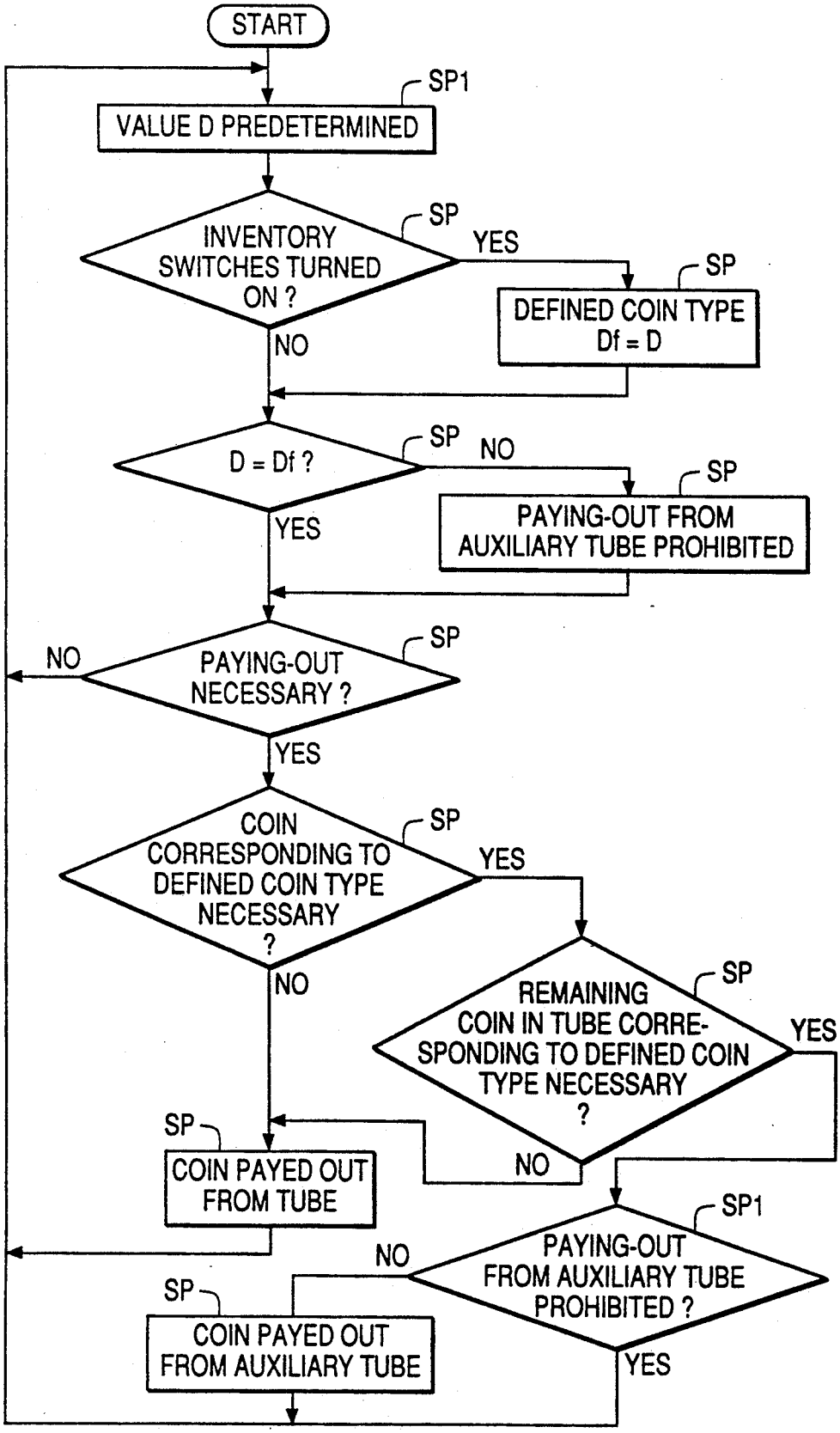
FIG. 4 is a flow chart of a coin return control system as shown in FIG. 2(*a*).

With reference to FIG. 4, a control algorithm of the control portion in accordance with one embodiment of this invention is shown in the form of a flowchart. The start of the process is designated step SP9.

At step SP10, predetermined value D predetermined by coin denomination predetermination switch 10 is input to control portion 11 responsive to polling by control portion 11. Then, it is determined in step SP11 whether or not inventory switch 8*d*, corresponding to auxiliary change retaining tube 6, is turned on for actuating a coin return via auxiliary tube 6. If switch 8*d* is turned on, the output of step SP11 is input to step SP12, and predetermined value D is stored in memory 11*a* as defined coin type value Df in step SP12. Although not shown in the flow chart, when switch 8*d* is turned on, the output of step SP11 may be also input to coin paying-out mechanism 7 to pay out a coin from auxiliary change retaining tube 6, and the operation of paying-out a coin may thus be tested.

If inventory switch 8*d* is not turned on, the output of step SP11 is input to step SP13, and it is determined in step SP13 whether or not predetermined denomination D equals defined coin denomination value Df. If predetermined value D does not equal defined coin denomination value Df stored in memory 11*a*, the output of step SP13 is input to step SP14 and the paying-out of a coin from auxiliary change retaining tube 6 is prohibited. This is conveniently accomplished by setting a flag in memory 11*a*. Otherwise, the output of step SP13 is input to step SP15, and it is determined in step SP15 whether or not it is necessary to pay out a coin. That is, it is determined therein whether or not it is necessary to pay out a coin based on the result of the comparison of the amount of the coin deposited through coin inlet 2*a* with the selling price of merchandise to be vended. If it is not necessary to pay out change, the output of step SP15 is returned to step SP10. Otherwise, the output of step SP15 is input to step SP16. It is determined in step SP16 whether or not the coin of the coin denomination corresponding to defined coin denomination value Df, i.e., the coin in auxiliary change retaining tube 6, is necessary for change pay out. For example, maybe only dimes will be required and nickels retained in auxiliary tube 6 are not required. If it is not necessary, that is, the coin in the auxiliary tube need not be used for change, the output of step SP16 is input to step SP17, and coin paying-out mechanism 7 is thus instructed so that a necessary coin can be paid out from change retaining tubes 3, 4 or 5 excluding the change retaining tube corresponding to the coin type of auxiliary change retaining tube 6.

If the coin denomination of the coins of the auxiliary tube should be used for change, the output of step SP16 is input to step SP18, and it is determined in step SP18 whether or not the number of the remaining coins in the change retaining tube 3, 4, or 5 corresponding to the defined coin type value Df is below a predetermined value, for example, has fallen to zero. If it is not below a predetermined value or zero, then, at step SP18 the output of step SP18 is input to step SP17. At step SP17, coins are paid out in change from the change retaining tube 3, 4 or 5 corresponding to the denomination of auxiliary tube 6. Otherwise, the output of step SP18 is input to step SP19, and it is determined in step SP19 whether or not the paying-out of a coin from auxiliary change retaining tube 6 is prohibited. If it is not prohibited, the output of step SP19 is input to step SP20, and the number of the necessary coins is paid out from auxiliary change retaining tube 6. Otherwise, the output of step SP19 is returned to step SP10.

As mentioned above, when predetermined denomination D of coin denomination predetermination switch 10 is changed despite the deactivation of inventory switch 8*d* corresponding to auxiliary change retaining tube 6, the paying-out of a coin from auxiliary change retaining tube 6 is prohibited. Accordingly, even though predetermined value D is intentionally varied because of the erroneous condition in the setting of coin denomination predetermination switch 10 or predetermined value D is varied because of invading liquid like water into coin denomination predetermination switch 10, the paying out of a coin of a different coin denomination from auxiliary change retaining tube 6 as change can be prevented.

In other words, in accordance with the present invention, steps SP12, SP13 and SP14 store and then verify the coin denomination status of the coin inventory switch 8*d* in comparison to the coin denomination of the coin denomination predetermination switch 10 and the coin to be stored in the auxiliary change retaining tube so that, if there is a mismatch between the stored defined value Df and the present denomination predetermination switch value D, the paying out of coins from the auxiliary change retaining tube may be prohibited. Consequently, later at step SP19 an erroneous coin value is not inadvertently paid out from the auxiliary change retaining tube as change.

This invention has been described in detail in connection with the preferred embodiments, but these are examples only and the invention is not restricted thereto. It will be easily understood by those skilled in the art that other variations and modifications can be easily made within the scope of this invention, which is limited in scope only by the following claims.

I claim:

1. A coin return control system for vending machines comprising:

a plurality of change retaining tubes, each corresponding to a coin denomination of deposited coins;

at least one auxiliary change retaining tube;

coin denomination predetermination switch means for predetermining a particular coin denomination of coins retained in said at least one auxiliary change retaining tube;

coin paying-out means for returning a coin from any one of said plurality of change retaining tubes and said at least one auxiliary change retaining tube;

a first switch means for forcing a return of a coin;

predetermined coin type detecting means for detecting the coin denomination predetermined by said coin denomination predetermination switch means every time a coin return may be required and when a return of a coin is forced;

memory means for memorizing the coin denomination detected by said predetermined coin type detecting means immediately after a return of a coin is forced;

variation detecting means for detecting a variation between the coin denomination detected by said predetermined coin type detecting means when a coin return may be required and the coin denomination memorized by said memory means;

instruction means for instructing said coin paying out means to return a coin from said at least one auxiliary change retaining tube when the number of the coins retained in a change retaining tube corresponding to the coin denomination memorized by said memory means is below a predetermined value; and determination means for determining whether said instruction means should instruct said coin paying-out means to return a coin from said at least one auxiliary change retaining tube based on the variation detected by said variation detecting means.

2. A coin control system according to claim 1 in which the predetermined value is one.

3. A coin control system for vending machines comprising an auxiliary change retaining tube, a control unit, a coin denomination predetermination switch having a switch position for indicating a particular coin denomination for coins retained in the auxiliary change retaining tube, wherein the control unit has a memory for retaining the particular coin denomination for coins retained in the auxiliary change retaining tube at a first predetermined time, the control unit prohibiting distribution of change from the auxiliary change retaining tube when the particular coin denomination retained in the memory for the auxiliary change retaining tube does not equal the denomination indicated by the switch position of the coin denomination predetermination switch at a second predetermined time after the first predetermined time.

4. A coin control system for vending machines comprising:

an auxiliary change retaining tube;

an inventory switch for forcing a distribution of change from the auxiliary change retaining tube when the inventory switch is actuated;

a coin denomination predetermination switch having a switch position for predetermining a particular coin denomination for coins retained in the auxiliary change retaining tube; and a control unit having a memory for retaining a particular coin denomination for the auxiliary change retaining tube predetermined by the position of the coin denomination predetermination switch when the inventory switch is actuated;

wherein the control unit prohibits distribution of change from the auxiliary change retaining tube when the particular coin denomination retained in the memory does not equal the particular coin denomination predetermined by the switch position of the coin denomination predetermination switch.

* * * * *